US010997923B2

(12) United States Patent
Lim et al.

(10) Patent No.: US 10,997,923 B2
(45) Date of Patent: May 4, 2021

(54) SCAN DRIVER AND A DISPLAY APPARATUS HAVING THE SAME

(71) Applicant: Samsung Display Co., Ltd., Yongin-si (KR)

(72) Inventors: Jae Keun Lim, Suwon-si (KR); Jun Yong Song, Hwaseong-si (KR); Jeonkyoo Kim, Seoul (KR)

(73) Assignee: Samsung Display Co., Lid., Yongin-si (KR)

( * ) Notice: Subject to any disclaimer, the term of this patent is extended or adjusted under 35 U.S.C. 154(b) by 0 days.

(21) Appl. No.: 16/695,927

(22) Filed: Nov. 26, 2019

(65) Prior Publication Data

US 2020/0193911 A1 Jun. 18, 2020

(30) Foreign Application Priority Data

Dec. 17, 2018 (KR) ..... 10-2018-0162785

(51) Int. Cl.
*G09G 3/3266* (2016.01)
*G09G 3/3258* (2016.01)

(52) U.S. Cl.
CPC ..... *G09G 3/3266* (2013.01); *G09G 3/3258* (2013.01); *G09G 2320/043* (2013.01)

(58) Field of Classification Search
CPC .... G06F 3/04166; G06F 3/0412; G06F 3/041; G06F 3/0488; G06F 3/0487; G06F 3/05; G06F 3/044; G06F 3/04184; G06F 3/03547; G06F 3/03; G06F 3/04883; G06F 3/01; G06F 3/00; G09G 3/3266; G09G 3/3258; G09G 2320/043; G09G 3/3208; G09G 3/32; G09G 3/30; G09G 3/22; G09G 3/2092; G09G 3/20; G09G 3/04; G09G 3/00; G09G 3/3225; G09G 2320/045; G09G 2320/046; G09G 2320/04; G09G 2320/0252; G09G 2320/0233; G09G 2320/02; G09G 2320/00; G09G 2300/0831; G09G 2310/0262; G09G 2320/0295; G09G 2300/0819; G09G 2300/0842; G09G 3/3233; G09G 2310/0286
See application file for complete search history.

(56) References Cited

U.S. PATENT DOCUMENTS

| | | | | |
|---|---|---|---|---|
| 8,957,882 | B2 * | 2/2015 | Lee | G11C 19/28 345/204 |
| 9,047,803 | B2 * | 6/2015 | Lee | G09G 3/29 |
| 9,071,230 | B2 * | 6/2015 | Kim | G09G 3/3674 |
| 9,087,468 | B2 * | 7/2015 | Yoon | G09G 3/3266 |
| 9,294,086 | B2 * | 3/2016 | Kwon | H03K 17/687 |
| 9,524,674 | B2 * | 12/2016 | Kwon | G09G 3/3225 |
| 9,673,806 | B2 * | 6/2017 | Kim | G09G 3/3266 |
| 9,870,730 | B2 * | 1/2018 | Kim | G09G 3/2092 |

(Continued)

FOREIGN PATENT DOCUMENTS

KR 10-2014-0052289 A 5/2014

*Primary Examiner* — Julie Anne Watko
(74) *Attorney, Agent, or Firm* — Lewis Roca Rothgerber Christie LLP

(57) ABSTRACT

A scan driver includes a charging part configured to charge a next scan signal in response to a sensing selection signal in an active period of a frame period, and an output control part configured to output the second clock signal in response to a voltage charged in the charging part in a vertical blank period of the frame period.

20 Claims, 10 Drawing Sheets

(56) References Cited

U.S. PATENT DOCUMENTS

| | | | | |
|---|---|---|---|---|
| 10,121,434 | B2 * | 11/2018 | Park | G11C 19/28 |
| 10,269,320 | B1 * | 4/2019 | Gong | G09G 3/3677 |
| 10,497,317 | B2 * | 12/2019 | Lim | G09G 3/3266 |
| 2014/0111092 | A1 * | 4/2014 | Kim | G09G 5/18 315/127 |
| 2016/0005357 | A1 * | 1/2016 | Cho | G09G 3/3233 345/78 |
| 2016/0370918 | A1 * | 12/2016 | Huang | G06F 3/044 |
| 2018/0181227 | A1 * | 6/2018 | Huang | G06F 3/044 |
| 2018/0181244 | A1 * | 6/2018 | Sato | G06F 3/04166 |
| 2018/0275804 | A1 * | 9/2018 | Huang | G06F 3/0418 |
| 2020/0184898 | A1 * | 6/2020 | Choi | G09G 3/3275 |
| 2020/0193912 | A1 * | 6/2020 | Park | G09G 3/3266 |

* cited by examiner

SCAN DRIVER AND A DISPLAY APPARATUS HAVING THE SAME

CROSS-REFERENCE TO RELATED APPLICATION

This application claims priority to and the benefit of Korean Patent Application No. 10-2018-0162785 filed on Dec. 17, 2018, the entirety of which is hereby incorporated by reference for all purposes as if fully set forth herein.

BACKGROUND

1. Field

Aspects of some example embodiments relate to a scan driver for generating a scan signal in a predetermined sensing period and a display apparatus having the scan driver.

2. Description of the Related Art

Recently, an organic emission display apparatus has been widely used as a display apparatus for electronic devices.

An organic emission display apparatus includes a plurality of pixels, each pixel including an organic light emitting diode and a pixel circuit for driving the organic light emitting diode. The pixel circuit includes a plurality of transistors and a plurality of capacitors.

The organic emission display apparatus includes a scan driver for driving scan lines for driving the plurality of pixel circuits. The scan driver provides scan signals sequentially to a plurality of scan lines for the pixels contained in the display panel.

The organic light emitting diodes included in pixel circuits and the driving transistors supplying current to the organic light emitting diodes may deteriorate over time due to prolonged use. The organic emission display apparatus may not display an image with a desired luminance due to deterioration of organic light emitting diodes or driving transistors.

The organic emission display apparatus applies a reference signal to the pixels, measures the current flowing through each of the pixels according to the reference signal, determines deterioration of the pixel based on the measured current, and compensates for deterioration of the pixel.

The deterioration compensation method includes an inner compensation method in which a compensation circuit is included in a pixel and an external compensation method in which a compensation circuit is located outside the panel to simplify a circuit structure in the pixel.

The external compensation method may be set within a power-off period of the organic emission display apparatus or within a frame period of the organic emission display apparatus.

The above information disclosed in this Background section is only for enhancement of understanding of the background of the invention and therefore it may contain information that does not constitute prior art.

SUMMARY

Aspects of some example embodiments of the inventive concept include a scan driver for generating a scan signal in a vertical blank period of a frame period.

Aspects of some example embodiments of the inventive concept include a display apparatus including the scan driver.

According to some example embodiments of the inventive concept, a scan driver includes: a plurality of circuit stages configured to output a plurality of scan signals, an n-th circuit stage ('n' is a natural number) including a first output part which outputs a second clock signal in response to a signal of a first node, a second output part which outputs a driving voltage in response to a signal of a second node, a first input part which transfers the signal of the first node to the first output part in response to the second clock signal, a second input part which transfers a previous scan signal to the first node in response to a first clock signal having a phase different from the second clock signal, a third input part which transfers the first clock signal to the second node in response to the signal of the first node, a charging part which charges a next scan signal in response to a sensing selection signal in an active period of a frame period, and an output control part which outputs the second clock signal in response to a voltage charged in the charging part in a vertical blank period of the frame period.

According to some example embodiments, the charging part may include an eleventh transistor including a control electrode receiving the sensing selection signal, a first electrode receiving an (n+1)-th scan signal and a second electrode connected to a third capacitor, and the third capacitor includes a first electrode receiving the driving voltage and a second electrode connected to the eleventh transistor.

According to some example embodiments, the n-th circuit stage may further include a reset part which resets the third capacitor using the driving voltage in response to a start signal received during an initial period of the frame period and a floating part which electrically floats the first node and the second node in response to a display-on signal.

According to some example embodiments, the reset part may include a fifteenth transistor including a control electrode receiving the start signal, a first electrode receiving the driving voltage, and a second electrode connected to the third node.

According to some example embodiments, the third capacitor may be reset using the driving voltage in response to the display-on signal.

According to some example embodiments, the floating part may include a twelfth transistor including a control electrode receiving the display-on signal, a first electrode receiving an (n−1)-th scan signal, and a second electrode connected to the second input part, a thirteenth transistor including a control electrode receiving the display-on signal, a first electrode connected to the first input part and a second electrode connected to the second node and a fourteenth transistor including a control electrode receiving the display-on signal, a first electrode connected to the second input part, and a second electrode connected to the first node.

According to some example embodiments, the first output part may include a seventh transistor including a control electrode connected to the first node, a first electrode receiving the first clock signal and a second electrode connected to the first output terminal, and a second capacitor including a first electrode connected to a first output terminal and a second electrode connected to the first node.

According to some example embodiments, the second output part may include a sixth transistor including a control electrode connected to the second node, a first electrode receiving the driving voltage, and a second electrode connected to the first output terminal, and a first capacitor including the first electrode receiving the driving voltage and a second electrode connected to the second node.

According to some example embodiments, the first output part may include a seventeenth transistor including a control electrode connected to the first node, a first electrode receiving a third clock signal having a different phase from the first and second clock signals, and a second electrode connected to a second output terminal, and a fourth capacitor including a first electrode connected to the second output terminal and a second electrode connected to the first node.

According to some example embodiments, the second output part may include a sixteenth transistor including a control electrode connected to the second node, a first electrode receiving the driving voltage, and a second electrode connected to the second output terminal.

According to some example embodiments of the inventive concept, a display apparatus includes a pixel circuit including an organic light emitting diode and a plurality of pixel transistors for driving the organic light emitting diode, a data driver which outputs a data voltage to the pixel circuit during an active period of a frame period, a sensing driver which receives a sensing signal from the pixel circuit during a vertical blank period of the frame period, and a scan driver which outputs a scan signal to the pixel circuit during the active period and a sensing scan signal to the selected pixel circuit during the vertical blank period, wherein an n-th circuit stage ('n' is a natural number) of the scan driver includes a first output part which outputs a second clock signal in response to a signal of a first node, a second output part which outputs a driving voltage in response to a signal of a second node, a first input part which transfers the signal of the first node to the first output part in response to a second clock signal, a second input part which transfers a previous scan signal to the first node in response to a first clock signal having a phase different from the second clock signal, a third input part which transfers the first clock signal to the second node in response to the signal of the first node, a charging part which charges a next scan signal in response to a sensing selection signal in an active period of a frame period, and an output control part which outputs the second clock signal in response to a voltage charged in the charging part in a vertical blank period of the frame period.

According to some example embodiments, the charging part may include an eleventh transistor including a control electrode receiving the sensing selection signal, a first electrode receiving an (n+1)-th scan signal and a second electrode connected to a third capacitor, and the third capacitor includes a first electrode receiving the driving voltage and a second electrode connected to the eleventh transistor.

According to some example embodiments, the n-th circuit stage may further include a reset part which resets the third capacitor using the driving voltage in response to a start signal received during an initial period of a frame period, and a floating part which electrically floats the first node and the second node in response to a display-on signal.

According to some example embodiments, the reset part may include a fifteenth transistor including a control electrode receiving the start signal, a first electrode receiving the driving voltage, and a second electrode connected to the third node.

According to some example embodiments, the third capacitor may be reset using the driving voltage in response to the display-on signal.

According to some example embodiments, the floating part may include a twelfth transistor including a control electrode receiving the display-on signal, a first electrode receiving an (n−1)-th scan signal, and a second electrode connected to the second input part, a thirteenth transistor including a control electrode receiving the display-on signal, a first electrode connected to the first input part and a second electrode connected to the second node, and a fourteenth transistor including a control electrode receiving the display-on signal, a first electrode connected to the second input part, and a second electrode connected to the first node.

According to some example embodiments, the first output part may include a seventh transistor including a control electrode connected to the first node, a first electrode receiving the first clock signal and a second electrode connected to the first output terminal, and a second capacitor including a first electrode connected to a first output terminal and a second electrode connected to the first node.

According to some example embodiments, the second output part may include a sixth transistor including a control electrode connected to the second node, a first electrode receiving the driving voltage, and a second electrode connected to the first output terminal, and a first capacitor including the first electrode receiving the driving voltage and a second electrode connected to the second node.

According to some example embodiments, the first output part may include a seventeenth transistor including a control electrode connected to the first node, a first electrode receiving a third clock signal having a different phase from the first and second clock signals, and a second electrode connected to a second output terminal, and a fourth capacitor including a first electrode connected to the second output terminal and a second electrode connected to the first node.

According to some example embodiments, the second output part may include a sixteenth transistor including a control electrode connected to the second node, a first electrode receiving the driving voltage, and a second electrode connected to the second output terminal.

According to the embodiments, the circuit stage stores the ON voltage of the next scan signal in response to the sensing selection signal in the data active period in which the data voltage is written to the pixel circuit, and may generate a sensing scan signal for the sensing mode based on the sensing clock signal activated in the vertical blank period of the frame period. Accordingly, the circuit size of the scan driver used in the display apparatus of an external compensation method may be relatively reduced.

BRIEF DESCRIPTION OF THE DRAWINGS

The above and other features and characteristics of some example embodiments of the inventive concept will become more apparent by describing in aspects of some example embodiments with reference to the accompanying drawings, in which.

DETAILED DESCRIPTION

Hereinafter, aspects of some example embodiments of the inventive concept will be explained in more detail with reference to the accompanying drawings.

Figure 1:
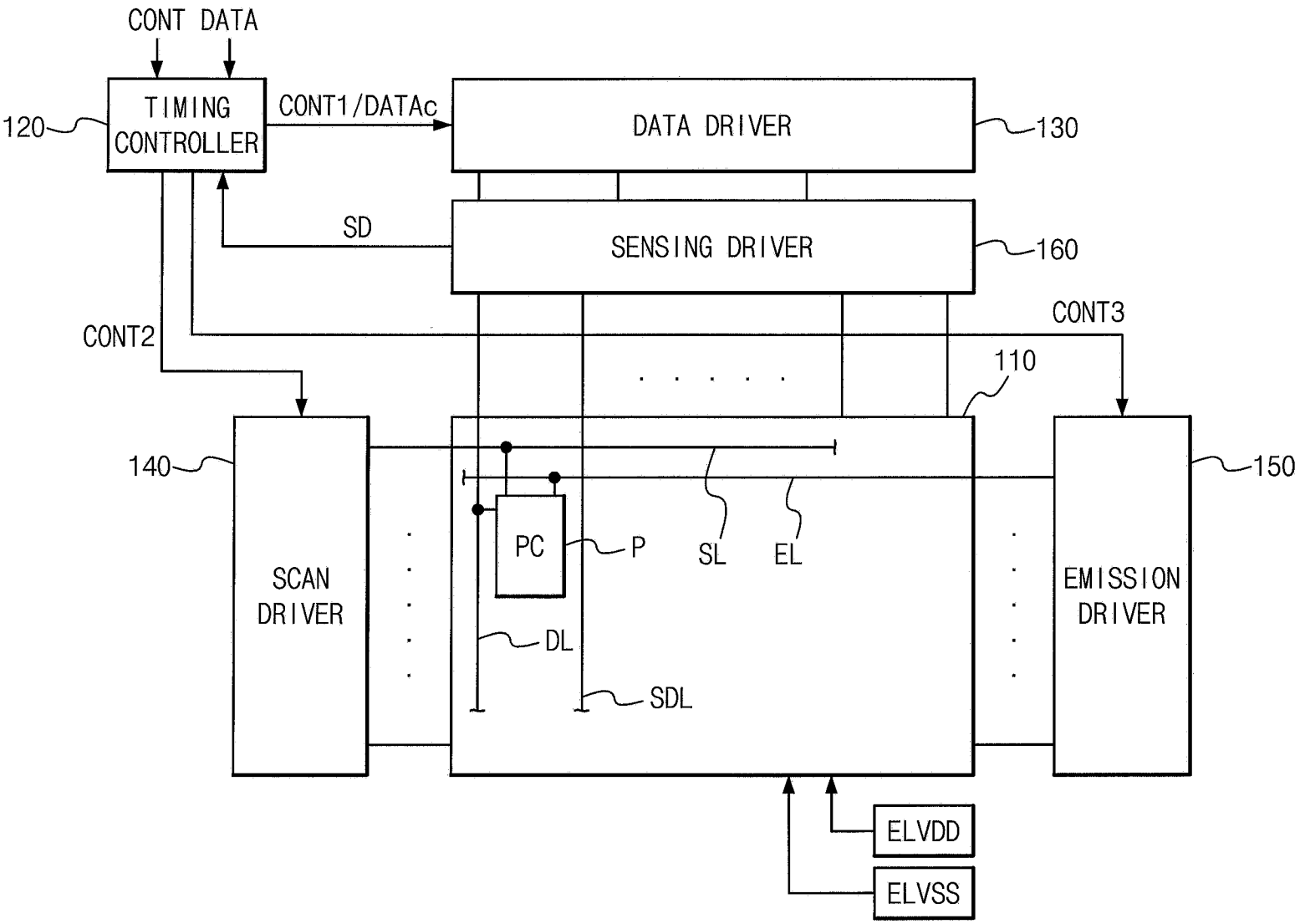
FIG. 1 is a block diagram illustrating a display apparatus according to some example embodiments.

FIG. 1 is a block diagram illustrating a display apparatus according to some example embodiments.

Referring to FIG. 1, the display apparatus may include a display panel 110, a timing controller 120, a data driver 130, a scan driver 140, an emission driver 150 and a sensing driver 160.

The display panel 110 includes a plurality of pixels P, a plurality of data lines DL, a plurality of sensing lines SDL, a plurality of scan lines SL, and a plurality of emission lines EL.

The pixels P may be arranged in a matrix form including a plurality of pixel rows and a plurality of pixel columns. Each pixel P includes a pixel circuit PC.

The plurality of data lines DL may extend in a column direction CD and be arranged in a row direction RD. The plurality of data lines DL1 is connected to the data driver 130 to transfer data voltages to the pixel circuits PC.

The plurality of sensing lines SDL may extend in the column direction CD and be arranged in the row direction (RD). The plurality of sensing lines SDL is connected to the sensing driver 160 to receive a sensing signal from the pixel circuit PC.

The plurality of scan lines SL may extend in the row direction RD and be arranged in the column direction CD. The scan line SL is connected to the scan driver 140 to transmit a scan signal to the pixels P.

The plurality of emission lines EL may extend in the row direction RD and be arranged in the column direction CD. The emission line EL is connected to the emission driver 150 and transmits an emission control signal to the pixel circuit PC.

In addition, the pixels P receive a first emission power supply voltage ELVDD and a second emission power supply voltage ELVSS.

The timing controller 120 receives an image signal DATA1 and a control signal CONT from an external device. The image signal DATA1 may include red, green, and blue data. The control signal CONT may include a horizontal sync signal Hsync, a vertical sync signal Vsync, and a main clock signal MCLK. The timing controller 120 outputs converted image data DATAc corresponding to a specification such as a pixel structure and a resolution of the display panel 110 with the image signal DATA. The timing controller 120 generates a first control signal CONT1 for driving the data driver 130 based on the control signal CONT and a second control signal CONT2 for driving the scan driver 140, and generates a third control signal CONT3 for driving the emission driver 150.

The data driver 130 converts the image data DATAc into a data voltage in response to the first control signal CONT1 and outputs the data voltage to the data line DL.

The scan driver 140 sequentially outputs a scan signal to the plurality of scan lines SL in an active period of a frame period in response to the second control signal CONT2. In addition, the scan driver 140 outputs a scan signal to a selected scan line in the vertical blank period of the frame period in response to the second control signal CONT2.

The emission driver 150 may simultaneously output an emission control signal of a first level to the emission control line EL according to the third control signal CONT3. Alternatively, the emission driver 150 may sequentially output an emission control signal of a first level to the emission control line EL according to the third control signal CONT3.

The sensing driver 160 is connected to the plurality of sensing lines SDL. The sensing driver 160 receives a sensing signal from the plurality of pixels of the display panel 110 during a vertical blank period of the frame period through the plurality of sensing lines SDL. The sensing driver 160 converts the sensing signal into sensing data SD, which is a digital signal, and provides the sensed data SD to the timing controller 120.

Figure 2:
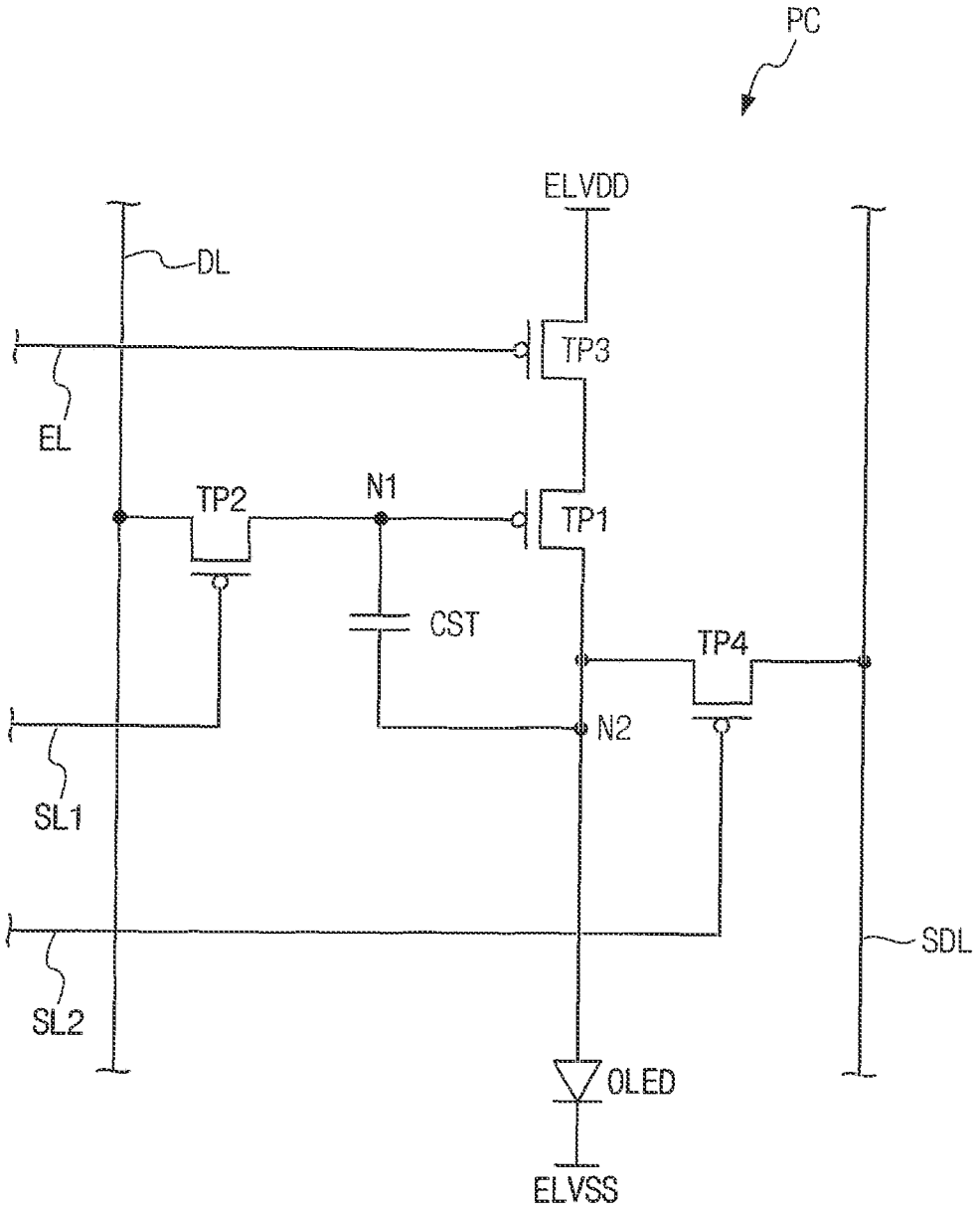
FIG. 2 is a circuit diagram illustrating a pixel circuit according to some example embodiments.

FIG. 2 is a circuit diagram illustrating a pixel circuit according to some example embodiments.

Referring to FIGS. 1 and 2, the pixel circuit PC may include an organic light emitting diode OLED and a plurality of pixel transistors TP1, TP2, TP3, and TP4 driving the organic light emitting diode OLED.

The first pixel transistor TP1 includes a first electrode connected to the first pixel node N1, a second electrode connected to the third pixel transistor TP3, and a third electrode connected to the second pixel node N2.

The second pixel transistor TP2 includes a first electrode connected to the first scan line SL1, a second electrode connected to the data line, and a third electrode connected to the first pixel node N1.

The third pixel transistor TP3 includes a first electrode connected to the emission line EL, a second electrode receiving the first power supply voltage ELVDD and a third electrode connected to the first pixel transistor TP1.

The fourth pixel transistor TP4 includes a first electrode connected to the second scan line SL2, a second electrode connected to the second pixel node N2, and a third electrode connected to the sensing line SDL. The second scan line SL2 may receive a scan signal different from the scan signal received on the first scan line SL1.

Alternatively, the first electrode of the fourth pixel transistor TP4, the first electrode of the second pixel transistor TP2, is connected to a same scan line and may receive a same scan signal.

The storage capacitor CST includes a first electrode connected to the first pixel node N1 and a second electrode connected to the second pixel node N2.

The organic light emitting diode OLED includes anode electrode connected to the second pixel node N2 and a cathode electrode receiving the second power supply voltage ELVSS.

The pixel circuit PC is driven in a display mode in which the organic light emitting diode OLED emits light with a luminance corresponding to the data voltage during the active period of the frame period. The pixel circuit PC is driven in a sensing mode in which a sensing signal formed on the pixel circuit PC is transmitted to the sensing driver 160 through the sensing line SDL during the vertical blank period of the frame period. The active period of the frame period may include a data-addressing period for writing to a pixel circuit PC and an emission period in which the organic light emitting diode OLED emits light based on the data voltage.

The pixel circuit PC is not limited to the pixel circuit of FIG. 2, and may be implemented by various circuits. In addition, the pixel transistors included in the pixel circuit PC may be a P-type transistor that turns on in response to a low voltage and turns off in response to a high voltage. Without being limited thereto, the transistors may be N-type transistors.

Figure 3:
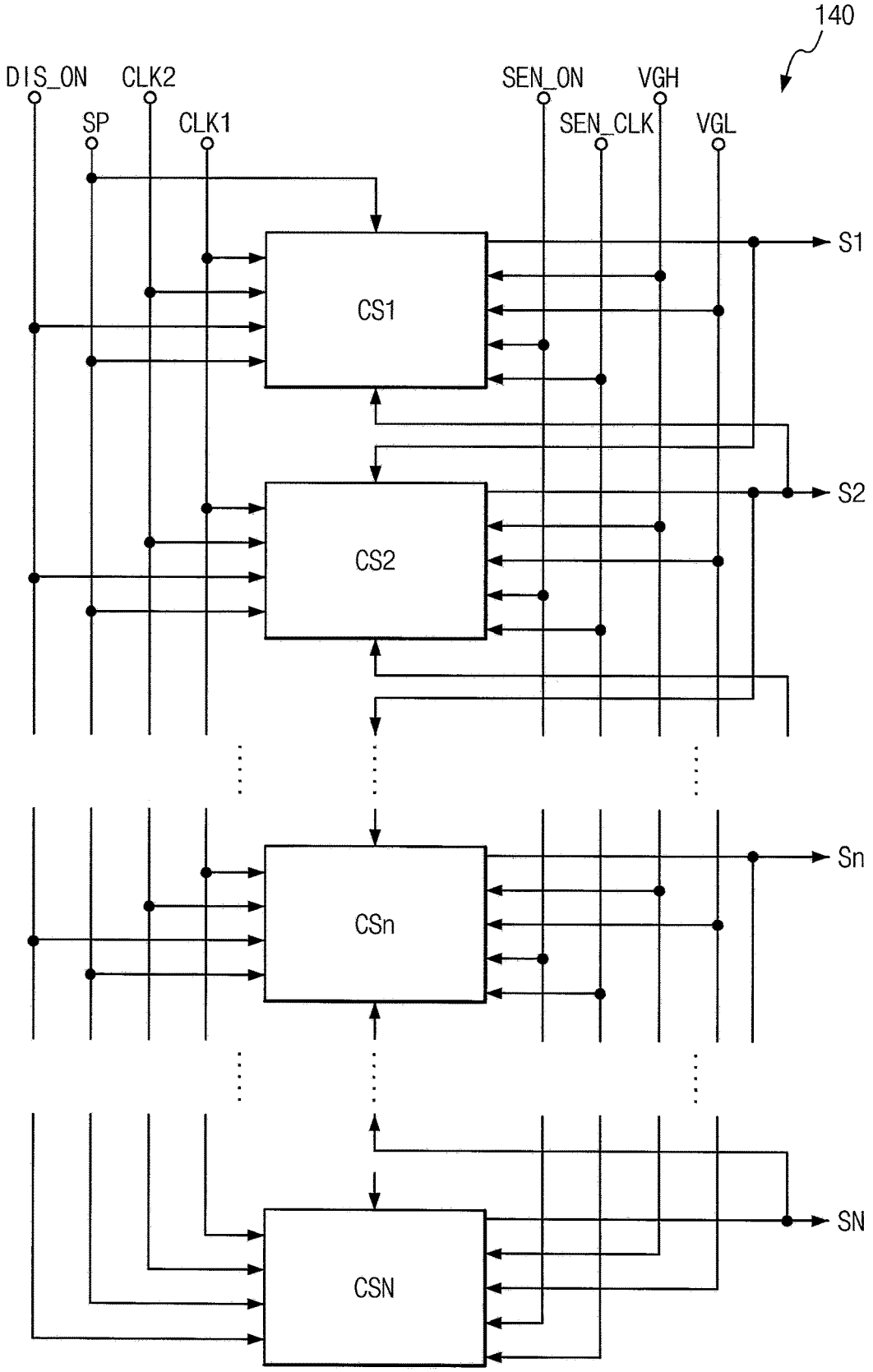
FIG. 3 is a block diagram illustrating a scan driver according to some example embodiments.

FIG. 3 is a block diagram illustrating a scan driver according to some example embodiments.

Referring to FIGS. 1, 2 and 3, the scan driver 140 includes a plurality of circuit stages CS1, . . . , CSn, . . . , CSN connected in a cascade manner to output a plurality of scan signals S1, S2, . . . , Sn, . . . , SN. Each scan signal includes an ON voltage and an OFF voltage that turn on and off the second and fourth pixel transistors TP2 and TP4 of the pixel circuit PC.

The plurality of circuit stages CS1, . . . , CSn, . . . , The CSN sequentially outputs the ON voltages of the plurality of scan signals S1, S2, . . . , Sn, . . . , SN during the data addressing period of the frame period and outputs the ON voltage of the selected scan signal during the vertical blank period of the frame period.

Each of the circuit stages CS1, . . . , CSn, . . . , CSN receives a first driving voltage VGL, a second driving voltage VGH, a start signal SP, a previous scan signal, a next scan signal, a first clock signal CLK1, a second clock signal CLK2, a display-on signal DIS_ON, a sensing selection signal SEN_ON and a sensing clock signal SEN_CLK.

The first driving voltage VGL has a level of an ON voltage which turns on the transistor of the circuit stage, and the second driving voltage VGH has a level of an OFF voltage which turns off the transistor of the circuit stage. For example, when the circuit stage utilizes a P-type transistor, the ON voltage may be a low voltage L and the OFF voltage may be a high voltage H. Alternatively, when the circuit stage utilizes an N-type transistor, the ON voltage may be a high voltage H and the OFF voltage may be a low voltage L.

Hereinafter, the circuit stage is described with respect to a P-type transistor, and accordingly, the ON voltage may be the low voltage (L) and the OFF voltage may be the high voltage (H), but embodiments are not limited thereto.

The start signal SP is a reset signal for initializing the plurality of circuit stages by each frame period.

The previous scan signal is a scan signal output from the previous circuit stage, and is used as a carry signal. The first circuit stage may be used as a carry signal for the start signal SP.

The next scan signal is a scan signal output from the next circuit stage, and is used as a source signal to generate the ON voltage (L) of the sensing scan signal in the vertical blank period.

The first clock signal CLK1 and the second clock signal CLK2 swing between the ON voltage (L) and the OFF voltage (H). The second clock signal CLK2 may have a delay difference of one horizontal period (1H) for the first clock signal CLK1. The first and second clock signals CLK1 and CLK2 swing between the ON voltage (L) and the OFF voltage (H) in the active period of the frame period and the ON voltage (L) or the OFF voltage may be maintained in the vertical blank period of the frame period.

The display-on signal DIS_ON has the ON voltage (L) during the active period of the frame period and the OFF voltage (H) during the vertical blank period of the frame period.

The sensing selection signal SEN_ON selects the scan signal of the scan line connected to the pixel circuit that is selected to operate with the sensing mode during the vertical blank period of the frame period of the plurality of scan lines. For example, when a pixel circuit connected to the n-th scan line of the plurality of scan lines is selected to operate with the sensing mode, the sensing selection signal SEN_ON may have the ON voltage in an (n+1)-th horizontal period that is a next horizontal period of the n-th horizontal period. Therefore, in the vertical blank period, the n-th scan signal has an ON voltage (L) and the pixel circuit connected to the n-th scan line may be driven in the sensing mode.

The sensing clock signal SEN_CLK has an OFF voltage (H) in the active period of the frame period and an ON voltage (L) in the vertical blank period of the frame period. The sensing clock signal SEN_CLK may control a pulse width corresponding to the ON voltage (L) of the scan signal for the sensing mode activated at the vertical blank period.

Figure 4:
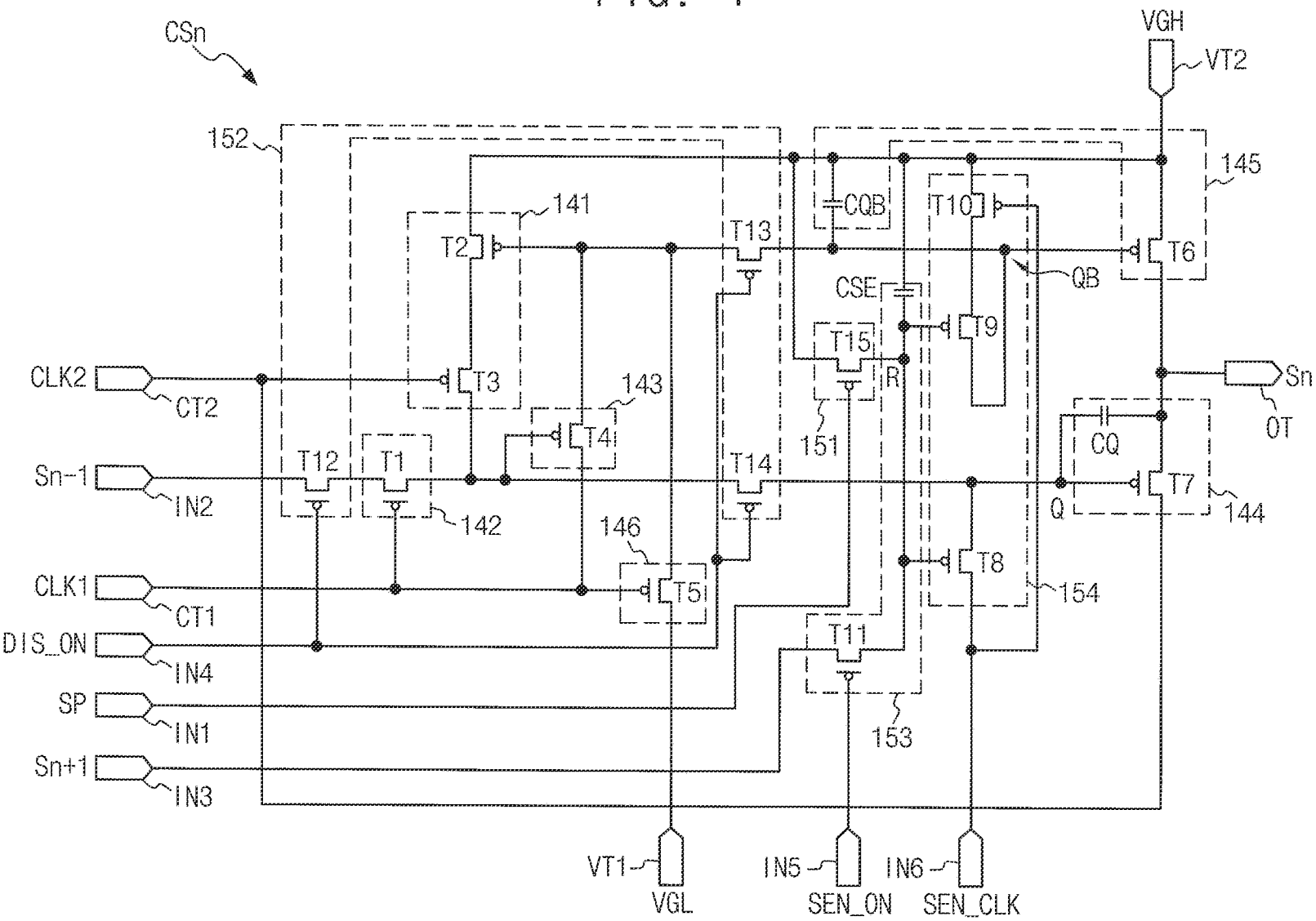
FIG. 4 is a circuit diagram illustrating an n-th circuit stage in FIG. 3.

FIG. 4 is a circuit diagram illustrating an n-th circuit stage in FIG. 3.

Referring to FIGS. 3 and 4, the n-th circuit stage CSn includes a first driving voltage terminal VT1, a second driving voltage terminal VT2, a first clock terminal CT1, a second clock terminal CT2, a first input terminal IN1, a second input terminal IN2, a third input terminal IN3, a fourth input terminal IN4, a fifth input terminal IN5, a sixth input terminal IN6 and an output terminal OT.

The first driving voltage terminal VT1 receives the first driving voltage VGL. The first driving voltage VGL may have a low voltage (L).

The second driving voltage terminal VT2 receives the second driving voltage VGH. The second driving voltage VGH may have a high voltage (H).

The first clock terminal CT1 receives the first clock signal CLK1.

The second clock terminal CT2 receives the second clock signal CLK2 delayed from the first clock signal CLK1. For example, the second clock signal CLK2 may be delayed by one horizontal period (1 H) from the first clock signal CLK1.

The first input terminal IN1 receives a start signal SP. The start signal SP is the control signal that initiates an operation of the scan driver.

The second input terminal IN2 receives the (n−1)-th scan signal Sn−1 of the (n−1)-th circuit stage located before the n-th circuit stage as a carry signal.

The third input terminal IN3 receives the (n+1)-th scan signal Sn+1 of the (n+1)-th circuit stage next to the n-th circuit stage.

The fourth input terminal IN4 receives a display-on signal DIS_ON.

The fifth input terminal IN5 receives a sensing selection signal SEN_ON.

The sixth input terminal IN6 receives a sensing clock signal SEN_CLK.

The output terminal OT receives an n-th scan signal Sn.

Hereinafter, the circuit stage will be described taking the n-th circuit stage CSn as one embodiment.

The transistors included in the circuit stage may be a P-type transistor that turns on in response to a low voltage and turns off in response to a high voltage. Without being limited thereto, the transistors may be an N-type transistors.

The n-th circuit stage CSn includes a first input part 141, a second input part 142, a third input part 143, a first output part 144, a second output part 145, a holding part 146, a reset part 151, a floating part 152, a charging part 153 and an output control part 154.

The first input part 141 transmits the signal of the first node Q to the second output part 145 in response to the second clock signal CLK2 received from the second clock terminal CT2. The first input part 141 includes a third transistor T3 and a second transistor T2. The third transistor T3 includes a control electrode receiving a second clock signal CLK2, a first electrode coupled to the Q node Q, and a second electrode connected to the second output part 145. The second transistor T2 includes a control electrode connected to the QB node QB, a first electrode receiving the second driving voltage VGH and a second electrode connected to the third transistor T3.

The second input part 142 transmits the (n−1)-th scan signal Sn−1 received from the second input terminal IN2 in response to the first clock signal CLK1 received from the first clock terminal CT1, to the Q node Q. The second input part 142 includes a first transistor T1. The first transistor T1 includes a control electrode receiving the first clock signal CLK1, a first electrode receiving the (n−1)-th scan signal Sn−1 and a second electrode connected to the Q node.

The third input part 143 transmits a first clock signal CLK1 received from the first clock terminal CT1 to the QB node QB in response to the signal of the Q node Q. The third input part 143 includes a fourth transistor T4. The fourth transistor T4 includes a control electrode connected to the Q node Q, a first electrode receiving the first clock signal CLK1 and a second electrode connected to the QB node QB.

The first output part 144 outputs a second clock signal CLK2 received from the second clock terminal CT2 to the output terminal OT in response to the signal of the Q node Q. The first output part 144 includes a seventh transistor T7 and a second capacitor CQ. The seventh transistor T7 includes a control electrode connected to the Q node Q, a first electrode receiving the first clock signal CLK1 and a second electrode connected to the output terminal OT. The second capacitor CQ includes a first electrode connected to the output terminal OT and a second electrode connected to the Q node Q.

The second output part 145 transmits the second driving voltage VGH received from the second driving voltage terminal VT2 to the output terminal OT in response to the signal of the QB node QB. The second output part 145 includes a sixth transistor T6 and a first capacitor CQB.

The sixth transistor T6 includes a control electrode connected to the QB node QB, a first electrode receiving the second driving voltage VGH and a second electrode connected to the output terminal OT. The first capacitor CQB includes a first electrode receiving the second driving voltage VGH and a second electrode connected to the QB node QB.

The holding part 146 receives the first driving voltage VGL received from the first driving voltage terminal VT1 in response to the first clock signal CLK1 received from the first clock terminal CT1. The holding part 146 includes a fifth transistor T5. The fifth transistor T5 includes a control electrode receiving a first clock signal CLK1, a first electrode receiving the first driving voltage VGL and a second electrode coupled to the QB node QB.

The reset part 151 applies the second driving voltage VGH received from the second driving voltage terminal VT2 to a third node (R node) R in response to a start signal SP received from the first input terminal IN1. The reset part 151 resets a third capacitor CSE. The reset part 151 includes a fifteenth transistor T15. The fifteenth transistor T15 includes a control electrode receiving the start signal SP, a first electrode receiving the second driving voltage VGH, and a second electrode connected to the R node R.

The floating part 152 electrically floats the Q node Q and the QB node QB in response to a display-on signal DIS_ON received from a fourth input terminal IN4. The floating part 152 includes a twelfth transistor T12, a thirteenth transistor T13, and a fourteenth transistor T14. The twelfth transistor T12 includes a control electrode receiving a display-on signal DIS_ON, a first electrode receiving an (n−1)-th scan signal Sn−1 and a second electrode connected to the second input part 142. The thirteenth transistor T13 includes a control electrode receiving the display-on signal DIS_ON, a first electrode coupled to a first input part 141, and a second electrode connected to the QB node QB. The fourteenth transistor T14 includes a control electrode receiving the display-on signal DIS_ON, a first electrode connected to a second input part 142, and a second electrode connected to the Q node Q.

The charging part 153 charges the voltage of an (n+1)-th scan signal Sn+1 received from a third input terminal IN3 in response to the sensing selection signal SEN_ON received from the fifth input terminal IN5. The charging part 153 includes an eleventh transistor T11 and a third capacitor CSE. The eleventh transistor T11 includes a control electrode receiving the sensing selection signal SEN_ON, a first electrode receiving the (n+1)-th scan signal Sn+1 and a second electrode connected to a third capacitor CSE. The third capacitor CSE includes a first electrode receiving the second driving voltage VGH and a second electrode connected to the eleventh transistor T11.

The output control part 154 electrically opens between the second output part 145 and the output terminal OT in response to a sensing clock signal SEN_CLK received from the sixth input terminal IN6. The output control part 154 outputs the low voltage L of the second clock signal CLK2 to the output terminal OT in response to a voltage charged in the charging part 153. The output control part 154 includes an eighth transistor T8, a ninth transistor T9 and a tenth transistor T10.

The eighth transistor T8 includes a control electrode connected to the R node R, a first electrode receiving the sensing clock signal SEN_CLK, and a second electrode connected to the Q node Q. The ninth transistor T9 includes a control electrode connected to the R node R, a first electrode receiving the second driving voltage VGH and a second electrode connected to the QB node QB. The tenth transistor T10 includes a control electrode receiving the sensing clock signal SEN_CLK, a first electrode receiving the second driving voltage VGH and a second electrode connected to the ninth transistor T9.

Figure 5:
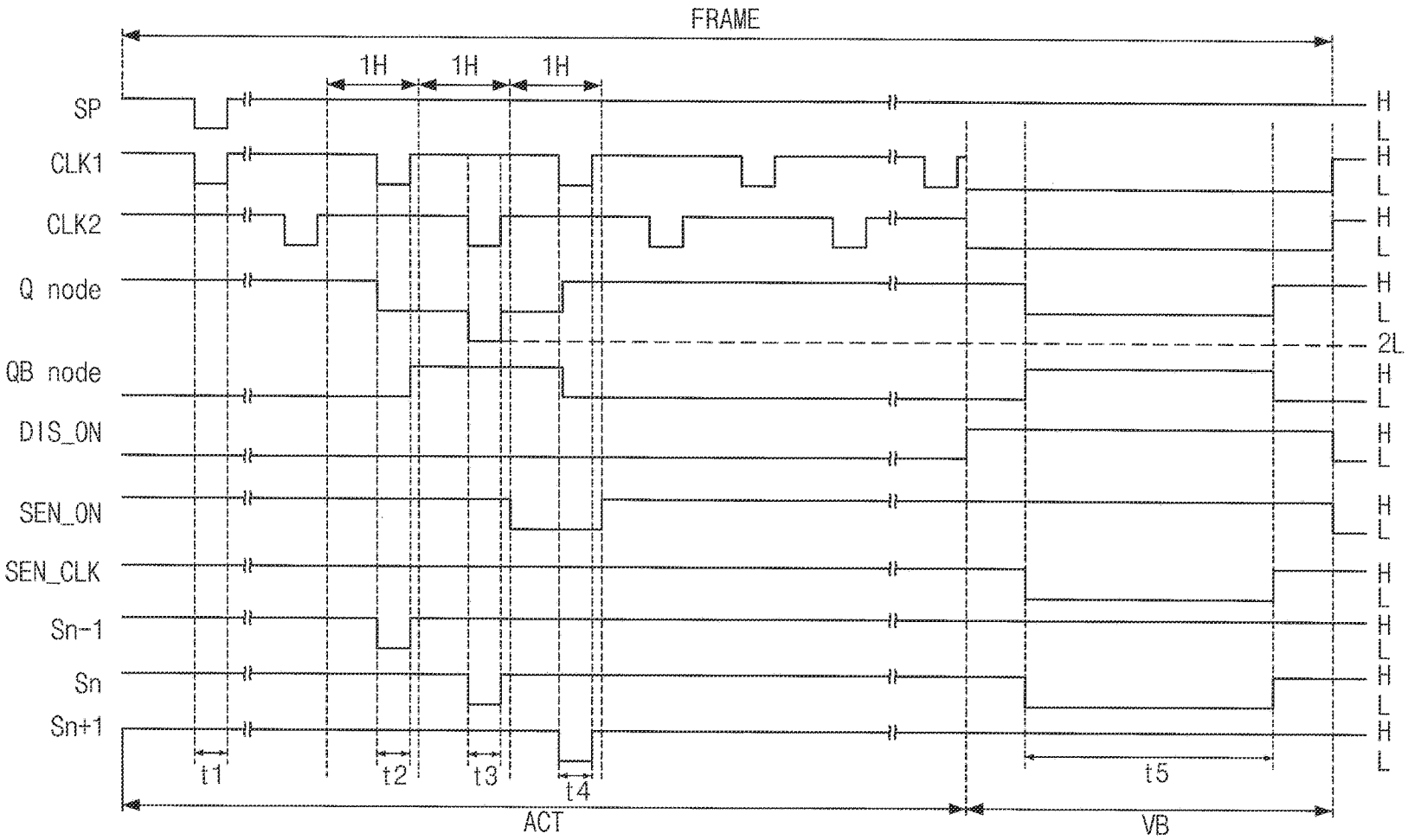
FIG. 5 is a waveform diagram illustrating a method of driving the n-th circuit stage in FIG. 4.

FIG. 5 is a waveform diagram illustrating a method of driving the n-th circuit stage in FIG. 4.

Referring to FIGS. 4 and 5, the driving method of the n-th circuit stage CSn may be described.

In a first period t1 of the active period ACT of the frame period FRAME, the fifteenth transistor T15 is turned on by a start signal SP with a low voltage L and a high voltage H of the second driving voltage VGH is applied to the first and second electrodes of the third capacitor CSE. Accordingly, the third capacitor CSE is reset.

In a second period t2, the first clock signal CLK1 has the low voltage L, the second clock signal CLK2 has the high voltage H, the (n−1)-th scan signal Sn−1 has the low voltage L, the start signal SP has the high voltage H, the (n+1)-th scan signal Sn+1 has the high voltage H, the display-on signal DIS_ON has the low voltage L, the sensing selection signal SEN_ON has the high voltage H and the sensing clock signal SEN_CLK has the high voltage H.

The twelfth, thirteenth, and fourteenth transistors T12, T13 and T14 of the floating part 152 are turned on in response to the display-on signal DIS_ON having the low voltage L. The first transistor T1 is turned on in response to the first clock signal CLK1 having the low voltage L and applies the low voltage L of the (n−1)-th scan signal Sn−1 to the Q node Q. The fourth transistor T4 is turned on in response to the low voltage L of the Q node Q. The fourth transistor T4 applies the low voltage L of the first clock signal CLK1 to the QB node QB.

The second clock signal CLK2, the sensing selection signal SEN_ON, the sensing clock signal SEN_CLK and the start signal SP which have the high voltage H are applied to the third, tenth, eleventh and fifteenth transistors T3, T10, T11, and T15. Thus, the third, tenth, eleventh and fifteenth transistors T3, T10, T11, and T15 are turned off.

In response to the low voltage L of the Q node Q, the seventh transistor T7 is turned on and the high voltage H of the second clock signal CLK2 is outputted to the output terminal. The sixth transistor T6 is turned on in response to the low voltage L of the QB node QB and the high voltage H of the second driving voltage VGH is outputted to the output terminal OT. Thus, in the second period t2, the n-th circuit stage CSn outputs an n-th scan signal Sn of high voltage H.

In third period t3, the first clock signal CLK1 has the high voltage H, the second clock signal CLK2 has the low voltage L, the (n−1)-th scan signal Sn−1 has the high voltage H, the start signal SP has the high voltage H, the (n+1)-th scan signal Sn+1 has the high voltage H, the display-on signal DIS_ON has the low voltage L, the sensing selection signal SEN_ON has the high voltage H and the sensing clock signal SEN_CLK has the high voltage H.

The twelfth, thirteenth, and fourteenth transistors T12, T13, and T14 of the floating part 152 are turned on in response to the display-on signal DIS_ON having the low voltage L. The first clock signal CLK1, the sensing selection signal SEN_ON, the sensing clock signal SEN_CLK and the start signal SP with high voltage H are applied to the control electrodes of the first, fifth, tenth, eleventh and fifteenth transistors T1, T5, T10, T11, and T15 and the first, fifth, tenth, eleventh and fifteenth transistors T1, T5, T10, T11, and T15 are turned off.

In response to the low voltage L of the Q node Q, the fourth transistor T4 is turned on and the high voltage H of the first clock signal CLK1 is applied to the QB node QB. The sixth transistor T6 is turned off in response to the high voltage of the QB node QB.

In response to the low voltage L of the Q node Q, the seventh transistor T7 is turned on and the low voltage L of the second clock signal CLK2 is applied to the output terminal OT. Accordingly, a voltage applied to the first electrode of the second capacitor CQ connected to the output terminal OT is changed from the high voltage H to the low voltage L, so that the second capacitor CQ is bootstrapped. Accordingly, the second electrode of the second capacitor CQ connected to the Q node Q has a bootstrap voltage 2L. In response to the bootstrap voltage 2L of the Q node Q, the seventh transistor T7 is turned on and the low voltage L of the second clock signal CLK2 is outputted to the output terminal OT. Therefore, in the third period t3, the n-th circuit stage CSn outputs the n-th scan signal Sn of the low voltage L.

In a fourth period t4, the first clock signal CLK1 has the low voltage L, the second clock signal CLK2 had the high voltage H, the (n−1)-th scan signal Sn−1 has the low voltage L, the start signal SP has the high voltage H, the (n+1)-th scan signal Sn+1 has the low voltage L, the display-on signal DIS_ON has the low voltage L, the sensing selection signal SEN_ON has the low voltage L and the sensing clock signal SEN_CLK has the high voltage H.

The twelfth, thirteenth, and fourteenth transistors T12, T13, and T14 of the floating part 152 are turned on in response to the display-on signal DIS_ON with the low voltage L. The second clock signal CLK2, the sensing clock signal SEN_CLK and the start signal SP which have the high voltage H are applied to the control electrodes of the third, tenth and fifteenth transistors T3, T10 and T15 and the third, tenth, and fifteenth transistors T3, T10, and T15 are turned off.

The first transistor T1 is turned on in response to the first clock signal CLK1 with the low voltage L and applied the high voltage H of the (n−1)-th scan signal Sn−1 to the Q node Q. The fifth transistor T5 is turned on in response to the first clock signal CLK1 with the low voltage L and applies the low voltage L of the first driving voltage VGL to the QB node QB. The sixth transistor T6 is turned on in response to the low voltage L of the QB node QB and the high voltage H of the second driving voltage VGH is outputted to the output terminal OT. Therefore, in the fourth period t4, the n-th circuit stage CSn outputs the n-th scan signal Sn of high voltage H.

The low voltage L of the (n+1)-th scan signal Sn+1 is applied to the third capacitor CSE in response to the sensing selection signal SEN_ON with the low voltage L. The third capacitor CSE charges the low voltage L of the (n+1)-th scan signal Sn+1.

In a fifth period t5 of the frame period which is included in the vertical blank period VB, the first clock signal CLK1 has the low voltage L, the second clock signal CLK2 has the low voltage L, the (n−1)-th scan signal Sn−1 has the high voltage H, the start signal SP has the high voltage H, the (n+1)-th scan signal Sn+1 has the high voltage H, the display-on signal DIS_ON has the high voltage H, the sensing selection signal SEN_ON has the high voltage H, and the sensing clock signal SEN_CLK has the low voltage L.

The twelfth, thirteenth and fourteenth transistors T12, T13 and T14 are turned off by the display-on signal DIS_ON having the high voltage H. Accordingly, both the Q node Q and the QB node QB are in a floating state.

The eleventh transistor T11 is turned off in response to the sensing selection signal SEN_ON with the high voltage H and the (n+1)-th scan signal Sn+1 with the low voltage L charged in the third capacitor CSE is applied to the R node R. The eighth and ninth transistors T8 and T9 are turned on in response to the low voltage L of the R node R and the tenth transistor T10 are turned on in response to the sensing clock signal SEN_CLK with the low voltage L. Accordingly, the second driving voltage VGH with the high voltage H are applied to the QB node QB by the turned-on ninth and tenth transistors T9 and T10. The sixth transistor T6 is turned off in response to the high voltage H of the QB node QB. However, the low voltage L of the sensing clock signal SEN_CLK is applied to the Q node Q by the turn-on eighth transistor T8. In response to the low voltage L of the Q node Q, the seventh transistor T7 is turned on and the low voltage L of the second clock signal CLK2 is outputted to the output terminal OT. Therefore, in the fifth period t5 of the vertical blank period VB, the n-th circuit stage CSn outputs the n-th scan signal Sn of the low voltage L.

Hereinafter, the same reference numerals are used to refer to the same or like parts as those described in the previous example embodiments, and the same detailed explanations are not repeated unless necessary.

Figure 6:
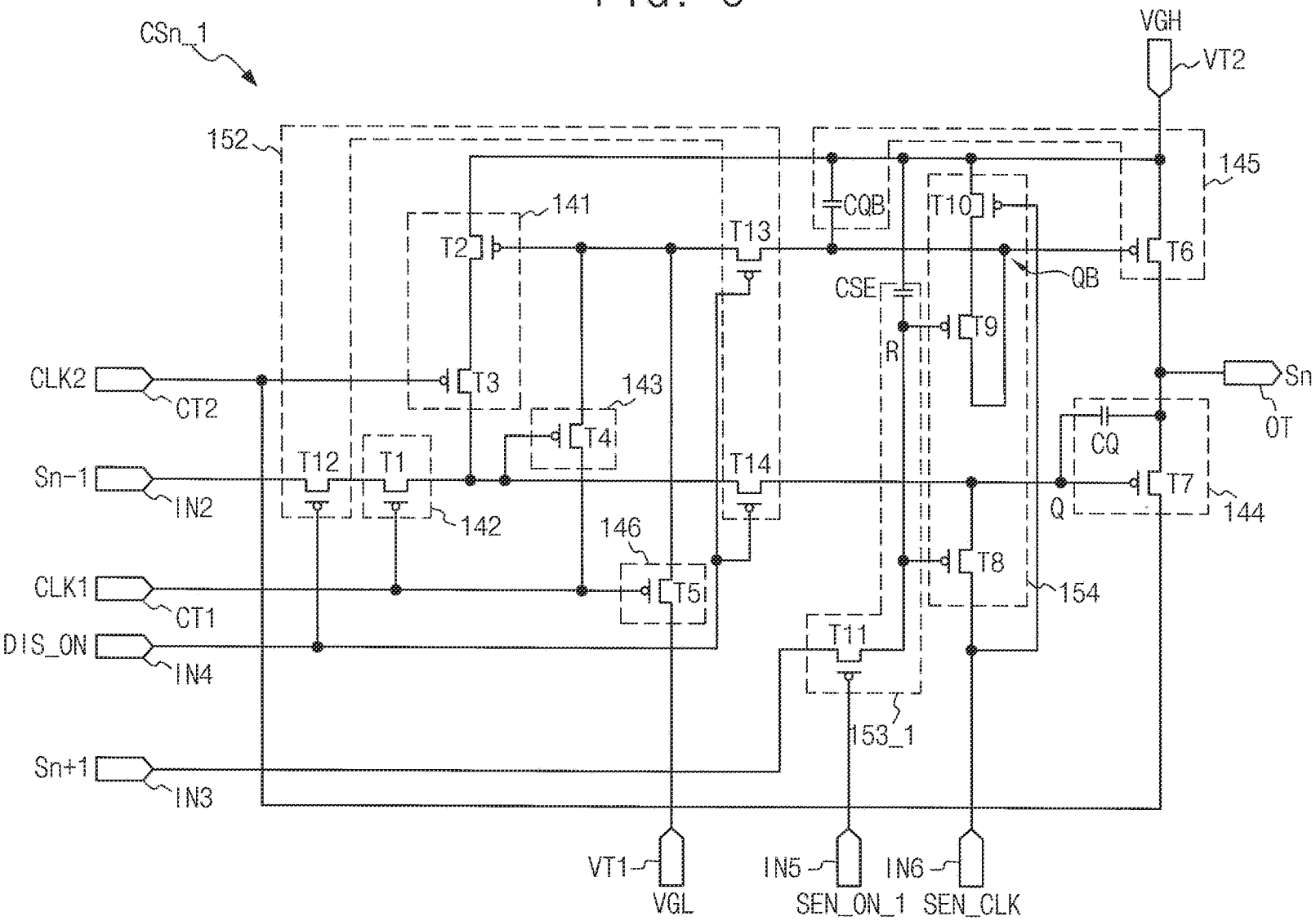
FIG. 6 is a circuit diagram illustrating an n-th circuit stage according to some example embodiments.
Figure 7:
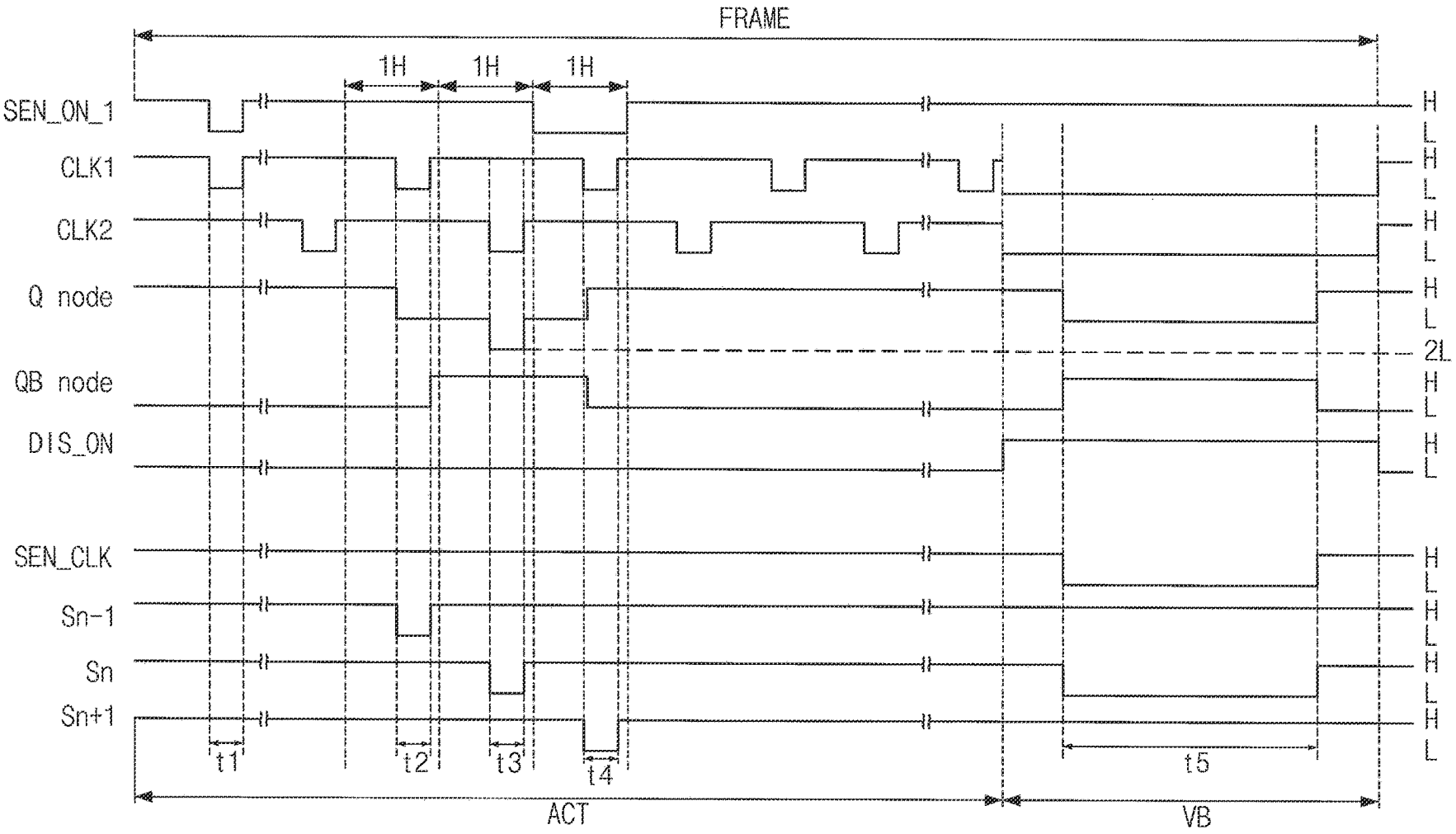
FIG. 7 is a waveform diagram illustrating a method of driving the n-th circuit stage in FIG. 6.

FIG. 6 is a circuit diagram illustrating an n-th circuit stage according to one embodiment. FIG. 7 is a waveform diagram illustrating a method of driving the n-th circuit stage in FIG. 6.

Referring to FIG. 6, the n-th circuit stage CSn_1 is compared with the n-th circuit stage CSn according to the embodiment shown in FIG. 4, and a start signal SP connected to the reset part 151 and the reset part 151. The first input terminal IN1 for receiving the first input terminal I_N1 is omitted.

Referring to FIG. 7, the input signals of the n-th circuit stage CSn_1 are compared with the input signals of the n-th circuit stage CSn according to the embodiment shown in FIG. 5, the phase of a sensing selection signal SEN_ON_1 is different from that of the sensing selection signal SEN_ON shown in FIG. 5.

The sensing selection signal SEN_ON_1 has a phase in which the start signal SP and the sensing selection signal SEN_ON shown in FIG. 5 are combined.

Referring to FIGS. 6 and 7, the n-th circuit stage CSn_1 may include a first input part 141, a second input part 142, third input part 143, a first output part 144, a second output part 145, a holding part 146, a floating part 152, a charging part 153_1 and an output control part 154.

The first input part 141 transfers the signal of the Q node Q to the second output part 145 in response to the second clock signal CLK2 received from the second clock terminal CT2. The first input part 141 includes a third transistor T3 and a second transistor T2.

The second input part 142 transfers the (n−1)-th scan signal Sn−1 received from the second input terminal IN2 in response to the first clock signal CLK1 received from the first clock terminal CT1 to the Q node Q. The second input part 142 includes a first transistor T1.

The third input part 143 transfers the first clock signal CLK1 received from the first clock terminal CT1 to the QB node QB in response to the signal of the Q node Q. The third input part 143 includes a fourth transistor T4.

The first output part 144 outputs a second clock signal CLK2 received from the second clock terminal CT2 to the output terminal OT in response to the signal of the Q node Q. The first output part 144 includes a seventh transistor T7 and a second capacitor CQ.

The second output part 145 transfers the second driving voltage VGH received from the second driving voltage terminal VT2 to the output terminal OT in response to the signal of the QB node QB. The second output part 145 includes a sixth transistor T6 and a first capacitor CQB.

The holding part 146 applies the first driving voltage VGL received from the first driving voltage terminal VT1 to the QB node QB in response to the first clock signal CLK1 received from the first clock terminal CT1. The holding part 146 includes a fifth transistor T5.

The floating part 152 electrically floats the QB node QB in response to the display-on signal DIS_ON received from the fourth input terminal IN4. The floating part 152 includes a twelfth transistor T12, a thirteenth transistor T13, and a fourteenth transistor T14.

The charging part 153_1 includes an eleventh transistor T11 and a third capacitor CSE. The charging part 153_1 includes an eleventh transistor T11 and a third capacitor CSE. The eleventh transistor T11 includes a control electrode receiving the sensing selection signal SEN_ON, a first electrode receiving the (n+1)-th scan signal Sn+1 and a second electrode connected to the third capacitor CSE. The third capacitor CSE includes a first electrode receiving the second driving voltage VGH and a second electrode connected to the eleventh transistor T11.

Referring to FIG. 7, the charging part 153_1 resets the third capacitor CSE in response to the sensing selection signal SEN_ON received from the fifth input terminal IN5 in the first period t1 using the high voltage H of the (n+1)-th scan signal Sn+1 received from the third input terminal IN3.

The charging part 153_1 charges the (n+1)-th scan signal Sn+1 received from the third input terminal IN3 to the third capacitor CSE in response to the sensing selection signal SEN_ON received from the fifth input terminal IN5 in the fourth period.

The output control part 154 electrically opens between the second output part 145 and the output terminal OT in response to a sensing clock signal SEN_CLK received from the sixth input terminal IN6. The output control part 154 outputs the low voltage L of the second clock signal CLK2 to the output terminal OT in response to the voltage charged in the charging part 153. The output control part 154 includes an eighth transistor T8, a ninth transistor T9 and a tenth transistor T10.

The n-th circuit stage CSn_1 according to the present embodiment may simplify the circuit implementation compared to the n-th circuit stage CSn shown in FIG. 4 according to some example embodiments.

Hereinafter, the same reference numerals are used to refer to the same or like parts as those described in the previous example embodiments, and the same detailed explanations are not repeated unless necessary.

Figure 8:
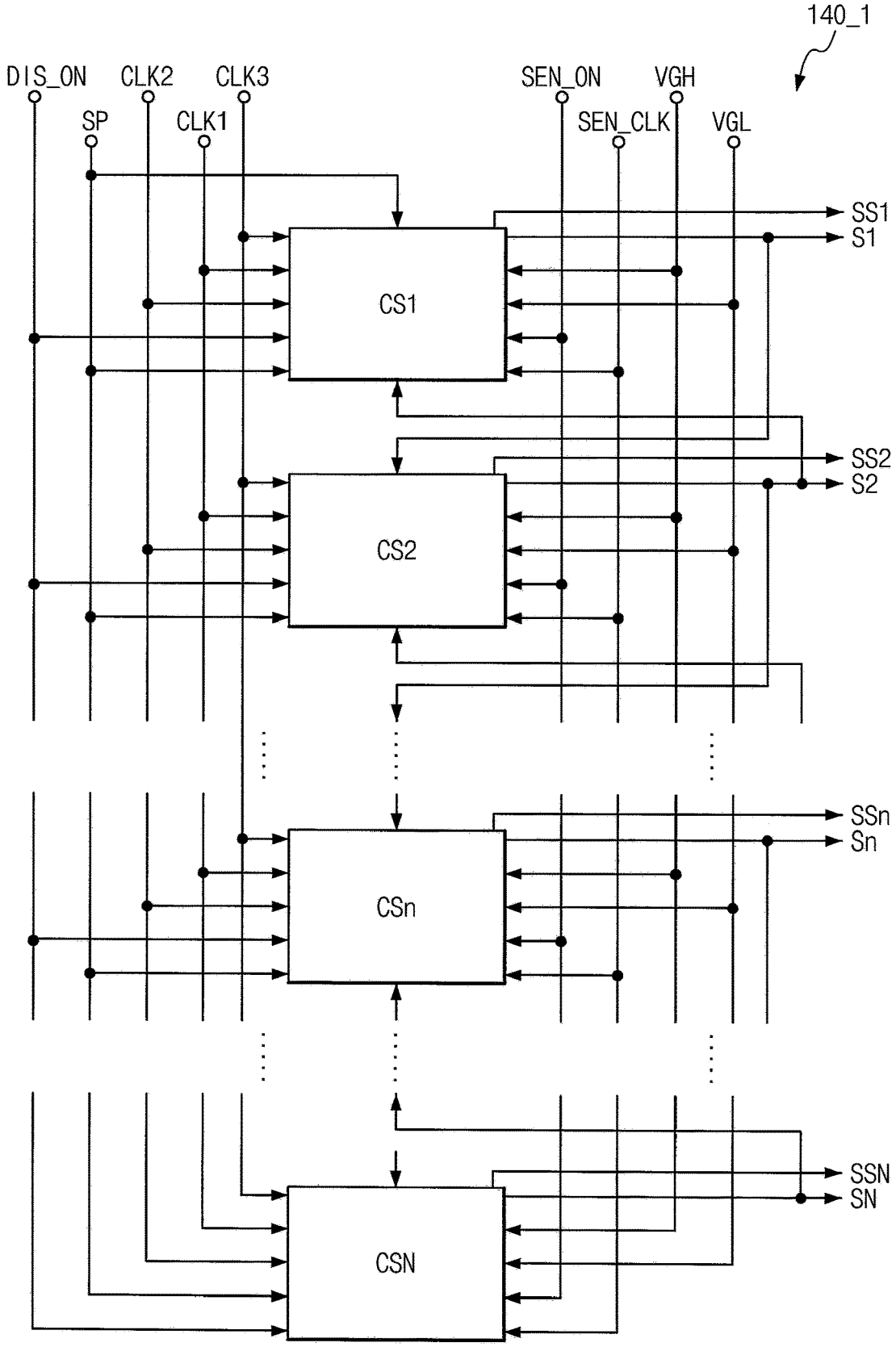
FIG. 8 is a block diagram illustrating a scan driver according to some example embodiments.

FIG. 8 is a block diagram illustrating a scan driver according to some example embodiments.

Referring to FIG. 8, the scan driver 140_1 includes a plurality of circuit stages CS1, . . . , CSn, . . . , CSN connected to each other. The plurality of circuit stages CS1, . . . , CSn, . . . , CSN outputs a plurality of scan signals S1, S2, . . . , Sn, . . . , SN and a plurality of sensing scan signals SS1, SS2, . . . , SSn, . . . , SSN.

Referring to the pixel circuit PC shown in FIG. 2, the n-th circuit stage CSn outputs an n-th scan signal Sn and an n-th sensing scan signal SSn.

The n-th scan signal Sn is applied to the first scan line SL1 connected to the first electrode of the second pixel transistor TP2. The n-th sensing scan signal SSn is applied to the second scan line SL2 connected to the first electrode of the fourth pixel transistor TP4.

The pixel circuit PC drives in the display mode that emits the organic light emitting diode OLED with a luminance corresponding to the data voltage in the active period of the frame period. The pixel circuit PC drives in the sensing mode that outputs the sensing signal generated in the pixel circuit PC through the sensing line SDL during the vertical blank period of the frame period. The active period of the frame period may include a data addressing period in which a data voltage is written to the pixel circuit PC and an emission period in which the organic light emitting diode OLED emits the light based on the data voltage.

The n-th scan signal Sn is a scan signal applied to the pixel circuit PC in the display mode and the n-th sensing scan signal SSn is a scan signal applied to the pixel circuit PC in the sensing mode.

According to the embodiment, each circuit stage of the scan driver 140_1 may provide a scan signal of the display mode and a scan signal of the sensing mode different from the scan signal of the display mode to the pixel circuit PC.

Figure 9:
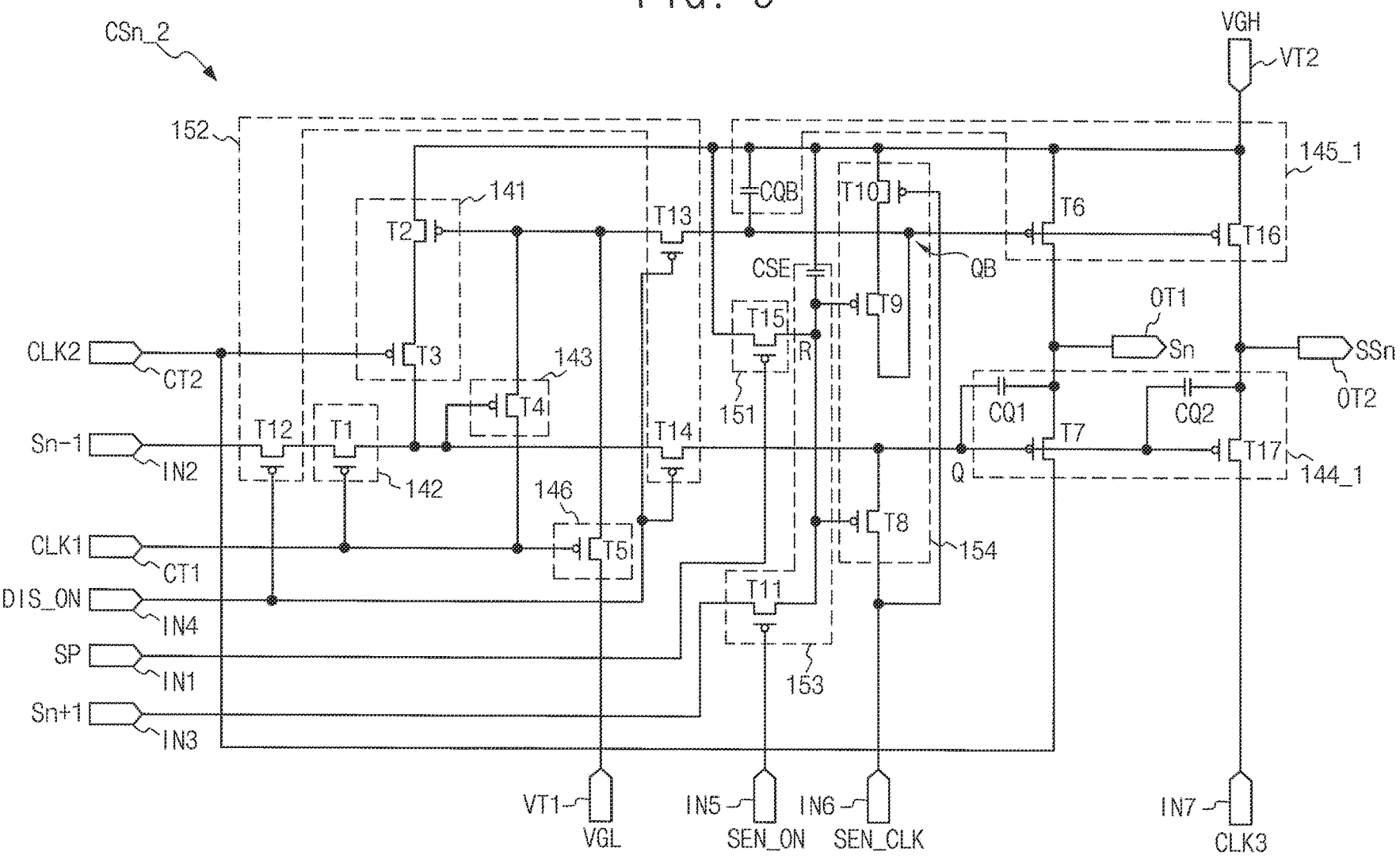
FIG. 9 is a circuit diagram illustrating an n-th circuit stage according to some example embodiments t.

FIG. 9 is a circuit diagram illustrating an n-th circuit stage according to one embodiment.

Referring to FIGS. 8 and 9, the n-th circuit stage CSn_2 may include a first driving voltage terminal VT1, a second driving voltage terminal VT2, a first clock terminal CT1, a second clock terminal CT2, a first Input terminal IN1, a second Input terminal IN2, a third input terminal IN3, a fourth input terminal IN4, a fifth input terminal IN5, a sixth input terminal IN6, a seventh input terminal IN7, a first output terminal OT1 and a second output terminal OT2.

The seventh input terminal IN7 receives a third clock signal CLK3. The third clock signal CLK3 has a phase different from phases of the first and second clock signals CLK1 and CLK2. For example, the third clock signal CLK3 has an OFF voltage (high voltage) in the active period and an ON voltage (low voltage) in the vertical blank period VB.

The first output terminal OT1 outputs the n-th scan signal Sn.

The second output terminal OT2 outputs the n-th sensing scan signal SSn.

The n-th circuit stage CSn_2 may include a first input part 141, a second input part 142, a third input part 143, a first output part 144_1, a second output part 145_1, a holding part 146, a reset part 151, a floating part 152, a charging part 153 and an output control part 154.

The first input part 141 transfers the signal of the Q node Q to the second output part 145 in response to the second clock signal CLK2 received from the second clock terminal CT2. The first input part 141 includes a third transistor T3 and a second transistor T2.

The second input part 142 transfers the (n−1)-th scan signal Sn−1 received from the second input terminal IN2 in response to the first clock signal CLK1 received from the first clock terminal CT1 to the Q node Q. The second input part 142 includes a first transistor T1.

The third input part 143 transfers the first clock signal CLK1 received from the first clock terminal CT1 to the QB node QB in response to the signal of the Q node Q. The third input part 143 includes a fourth transistor T4.

The first output part 144_1 outputs the second clock signal CLK2 received from the second clock terminal CT2 to the first output terminal OT1 in response to the signal of the Q node Q. In addition, the first output part 144_1 outputs the first clock signal CLK1 received from the first clock terminal CT1 to the second output terminal OT2 in response to the signal of the Q node Q.

The first output part 144_1 includes a seventh transistor T7, a second capacitor CQ1, a seventeenth transistor T17, and a fourth capacitor CQ2. The seventh transistor T7 includes a control electrode connected to the Q node Q, a first electrode receiving the second clock signal CLK2 and a second electrode connected to the first output terminal OT1. The second capacitor CQ1 includes a first electrode connected to the first output terminal OT1 and a second electrode connected to the Q node Q. The seventeenth transistor T17 includes a control electrode connected to the Q node Q, a first electrode receiving the third clock signal CLK3 and a second electrode connected to the second output terminal OT2. The first capacitor CQ4 includes a first electrode connected to the second output terminal OT2 and a second electrode connected to the Q node Q.

The second output part 145_1 transfers the second driving voltage VGH received from the second driving voltage terminal VT2 to the output terminal OT in response to the signal of the QB node QB. The second output part 145_1 includes a sixth transistor T6, a first capacitor CQB, and a sixteenth transistor T16.

The sixth transistor T6 includes a control electrode connected to the QB node QB, a first electrode receiving the second driving voltage VGH and a second electrode connected to the first output terminal OT1. The first capacitor CQB includes a first electrode receiving the second driving voltage VGH and a second electrode connected to the QB node QB. The sixteenth transistor T16 includes a control electrode connected to the QB node QB, a first electrode receiving the second driving voltage VGH and a second electrode connected to the second output terminal OT2.

Figure 10:
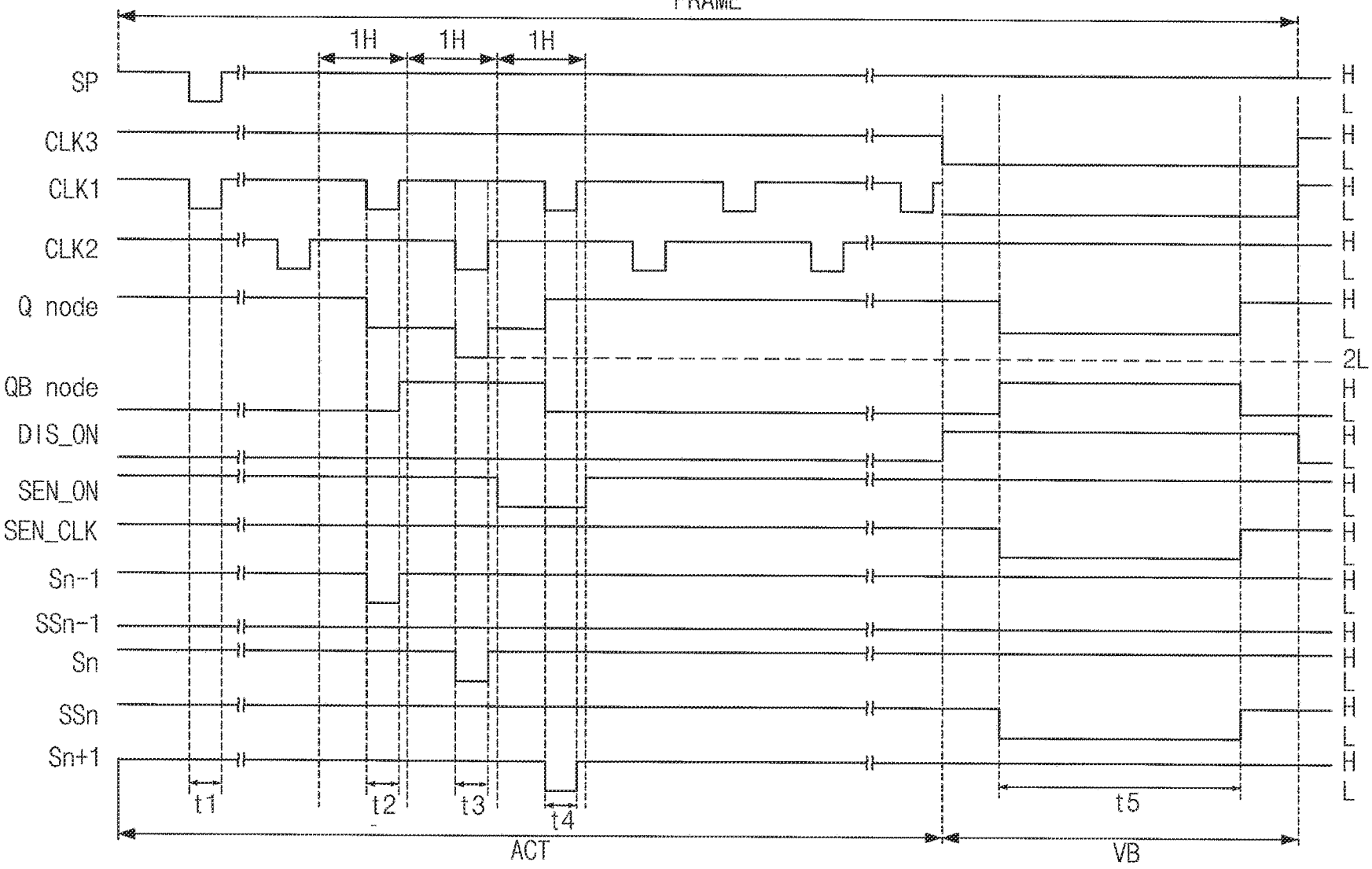
FIG. 10 is a waveform diagram illustrating a method of driving the n-th circuit stage in FIG. 9.

FIG. 10 is a waveform diagram illustrating a method of driving the n-th circuit stage in FIG. 9.

Referring to FIGS. 9 and 10, the driving method of the n-th circuit stage CSn_2 may be described.

In a first period t1 of the active period ACT of the frame period FRAME, the fifteenth transistor T15 is turned on by a start signal SP with a low voltage L and a high voltage H of the second driving voltage VGH is applied to the first and second electrodes of the third capacitor CSE. Accordingly, the third capacitor CSE is reset.

In a second period t2, in response to a first clock signal CLK1 with a low voltage L, the first transistor T1 is turned on and applies the low voltage L of the (n−1)-th scan signal Sn−1 to the Q node Q. The fourth transistor T4 is turned on in response to the low voltage L of the Q node Q and applies the low voltage L of the first clock signal CLK1 to the QB node QB.

The sixth transistor T6 is turned on in response to the low voltage L of the QB node QB and the high voltage H of the second driving voltage VGH is outputted to the first output terminal OT1. In response to the low voltage L of the QB node QB, the sixteenth transistor T16 is turned on and the high voltage H of the second driving voltage VGH is outputted to the second output terminal OT2.

In response to the low voltage L of the Q node Q, the seventh transistor T7 is turned on and the high voltage H of the second clock signal CLK2 is outputted to the second output terminal OT2. In response to the low voltage L of the Q node Q, the seventeenth transistor T17 is turned on and the high voltage H of the third clock signal CLK3 is outputted to the second output terminal OT2.

Therefore, the first output terminal OT1 of the n-th circuit stage CSn outputs the n-th scan signal Sn of the high voltage H and the second output terminal OT2 outputs an n-th sensing scan signal SSn of the high voltage H.

In a third period t3, the sixth and sixteenth transistors T6 and T16 are turned off in response to the high voltage H of the QB node QB.

A voltage applied to the first electrode of the second capacitor CQ1 connected to the first output terminal OT1 is varied from the high voltage H to the low voltage L, so that the second capacitor CQ1 is bootstrapped. Accordingly, the second electrode of the second capacitor CQ1 connected to the Q node Q may have a bootstrap voltage 2L. The seventh transistor T7 is turned on in response to the bootstrap voltage 2L of the Q node Q and the low voltage L of the second clock signal CLK2 is outputted to the first output terminal OT1.

The seventeenth transistor T17 is turned on in response to the bootstrap voltage 2L of the Q node Q and the high voltage H of the third clock signal CLK3 is outputted to the second output terminal OT2.

Thus, at the third period t3, the first output terminal OT1 of the n-th circuit stage CSn outputs the n-th scan signal Sn of the low voltage L, and the second output terminal OT2 of the n-th circuit stage CSn outputs an n-th sensing scan signal SSn of the high voltage H.

In a fourth period t4, the low voltage L of the (n+1)-th scan signal Sn+1 is applied to the third capacitor CSE in response to a sensing selection signal SEN_ON with the low voltage L. The third capacitor CSE charges the low voltage L of the (n+1)-th scan signal Sn+1.

In a fifth period t5 in the vertical blank period VB of the frame period, the twelfth, thirteenth and fourteenth transistors T12, T13 and T14 are turned off by the display-on signal DIS_ON having the high voltage H. Accordingly, both the Q node Q and the QB node QB are in a floating state.

The eleventh transistor T11 is turned off in response to the sensing selection signal SEN_ON having the high voltage H and the R node R receives the low voltage L of the (n+1)-th scan signal Sn+1 charged in the third capacitor CSE. The eighth and ninth transistors T8 and T9 are turned on in response to the low voltage L of the R node R and the tenth transistor T10 is turned on in response to the sensing clock signal SEN_CLK with the low voltage L. Accordingly, the high voltage H of the second driving voltage VGH is applied to the QB node QB by the turned-on ninth and tenth transistors T9 and T10.

The sixth and sixteenth transistors T6 and T16 are turned off in response to the high voltage H of the QB node QB.

The low voltage L of the sensing clock signal SEN_CLK is applied to the Q node Q by the turn-on eighth transistor T8. In response to the low voltage L of the Q node Q, the seventh transistor T7 is turned on and the high voltage H of the second clock signal CLK2 is outputted to the first output terminal OT1. In response to the low voltage L of the Q node Q, the seventeenth transistor T17 is turned on and the low voltage L of the third clock signal CLK3 is outputted to the second output terminal OT2.

Therefore, in the fifth period t5 of the vertical blank period VB, the first output terminal OT1 of the n-th circuit stage CSn outputs the n-th scan signal Sn of the high voltage H and the second output terminal OT2 outputs the n-th sensing scan signal SSn of the low voltage L.

Therefore, the n-th circuit stage may independently generate the n-th scan signal and the n-th sensing scan signal having different phases in the active period and the vertical blank period.

According to some example embodiments, the circuit stage stores the ON voltage of the next scan signal in response to the sensing selection signal in the data active period in which the data voltage is written to the pixel circuit, and may generate a sensing scan signal for the sensing mode based on the sensing clock signal activated in the vertical blank period of the frame period. Accordingly, the circuit size of the scan driver used in the display apparatus of an external compensation method may be reduced.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of the inventive concept and is not to be construed as limiting thereof. Although a few embodiments of the inventive concept have been described, those skilled in the art will readily appreciate that many modifications are possible in the embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific embodiments disclosed, and that modifications to the disclosed embodiments, as well as other embodiments, are intended to be included within the scope of the appended claims, and their equivalents. The inventive concept is defined by the following claims, with equivalents of the claims to be included therein.

What is claimed is:

1. A scan driver comprising a plurality of circuit stages configured to output a plurality of scan signals, an n-th circuit stage comprising ('n' is a natural number):

a first output part configured to output a second clock signal in response to a signal of a first node;

a second output part configured to output a driving voltage in response to a signal of a second node;

a first input part configured to transfer the signal of the first node to the second output part in response to the second clock signal;

a second input part configured to transfer a previous scan signal to the first node in response to a first clock signal having a phase different from the second clock signal;

a third input part configured to transfer the first clock signal to the second node in response to the signal of the first node;

a charging part configured to charge a next scan signal in response to a sensing selection signal in an active period of a frame period; and an output control part configured to enable the second clock signal to be output in response to a voltage charged in the charging part in a vertical blank period of the frame period.

2. The scan driver of claim 1, wherein the charging part comprises:

an eleventh transistor comprising a control electrode configured to receive the sensing selection signal, a first electrode configured to receive an (n+1)-th scan signal and a second electrode connected to a third capacitor, and the third capacitor comprising a first electrode configured to receive the driving voltage and a second electrode connected to the eleventh transistor.

3. The scan driver of claim 2, wherein the n-th circuit stage further comprises:

a reset part configured to reset the third capacitor using the driving voltage in response to a start signal received during an initial period of the frame period; and a floating part configured to electrically float the first node and the second node in response to a display-on signal.

4. The scan driver of claim 3, wherein the reset part comprises a fifteenth transistor comprising a control electrode configured to receive the start signal, a first electrode configured to receive the driving voltage, and a second electrode connected to a third node.

5. The scan driver of claim 4, wherein the third capacitor is reset using the driving voltage.

6. The scan driver of claim 3, wherein the floating part comprises:

a twelfth transistor comprising a control electrode configured to receive the display-on signal, a first electrode configured to receive an (n−1)-th scan signal, and a second electrode connected to the second input part;

a thirteenth transistor comprising a control electrode configured to receive the display-on signal; a first electrode connected to the first input part and a second electrode connected to the second node; and a fourteenth transistor comprising a control electrode configured to receive the display-on signal, a first electrode connected to the second input part, and a second electrode connected to the first node.

7. The scan driver of claim 1, wherein the first output part comprises:

a seventh transistor comprising a control electrode connected to the first node, a first electrode configured to receive the second clock signal and a second electrode connected to a first output terminal; and a second capacitor comprising a first electrode connected to the first output terminal and a second electrode connected to the first node.

8. The scan driver of claim 7, wherein the second output part comprises:

a sixth transistor comprising a control electrode connected to the second node, a first electrode configured to receive the driving voltage, and a second electrode connected to the first output terminal; and a first capacitor comprising the first electrode configured to receive the driving voltage and a second electrode connected to the second node.

9. The scan driver of claim 8, wherein the first output part comprises:

a seventeenth transistor comprising a control electrode connected to the first node, a first electrode configured to receive a third clock signal having a different phase from the first and second clock signals, and a second electrode connected to a second output terminal; and a fourth capacitor comprising a first electrode connected to the second output terminal and a second electrode connected to the first node.

10. The scan driver of claim 9, wherein the second output part comprises a sixteenth transistor comprising a control electrode connected to the second node, a first electrode configured to receive the driving voltage, and a second electrode connected to the second output terminal.

11. A display apparatus comprising:

a pixel circuit comprising an organic light emitting diode and a plurality of pixel transistors configured to drive the organic light emitting diode;

a data driver configured to output a data voltage to the pixel circuit during an active period of a frame period;

a sensing driver configured to receive a sensing signal from the pixel circuit during a vertical blank period of the frame period; and a scan driver configured to output a scan signal to the pixel circuit during the active period and a sensing scan signal to the pixel circuit during the vertical blank period, wherein an n-th circuit stage ('n' is a natural number) of the scan driver comprises:

a first output part configured to output a second clock signal in response to a signal of a first node;

a second output part configured to output a driving voltage in response to a signal of a second node;

a first input part configured to transfer the signal of the first node to the second output part in response to a second clock signal;

a second input part configured to transfer a previous scan signal to the first node in response to a first clock signal having a phase different from the second clock signal;

a third input part configured to transfer the first clock signal to the second node in response to the signal of the first node;

a charging part configured to charge a next scan signal in response to a sensing selection signal in an active period of a frame period; and an output control part configured to enable the second clock signal to be output in response to a voltage charged in the charging part in a vertical blank period of the frame period.

12. The display apparatus of claim 11, wherein the charging part comprises:

an eleventh transistor comprising a control electrode configured to receive the sensing selection signal, a first electrode configured to receive an (n+1)-th scan signal and a second electrode connected to a third capacitor, and the third capacitor comprises a first electrode configured to receive the driving voltage and a second electrode connected to the eleventh transistor.

13. The display apparatus of claim 12, wherein the n-th circuit stage further comprises:

a reset part configured to reset the third capacitor using the driving voltage in response to a start signal received during an initial period of a frame period; and a floating part configured to electrically float the first node and the second node in response to a display-on signal.

14. The display apparatus of claim 13, wherein the reset part comprises a fifteenth transistor comprising a control electrode configured to receive the start signal, a first electrode configured to receive the driving voltage, and a second electrode connected to a third node.

15. The display apparatus of claim 14, wherein the third capacitor is reset using the driving voltage.

16. The display apparatus of claim 13, wherein the floating part comprises:

a twelfth transistor comprising a control electrode configured to receive the display-on signal, a first electrode configured to receive an (n−1)-th scan signal, and a second electrode connected to the second input part;

a thirteenth transistor comprising a control electrode configured to receive the display-on signal, a first electrode connected to the first input part and a second electrode connected to the second node; and a fourteenth transistor comprising a control electrode configured to receive the display-on signal, a first electrode connected to the second input part, and a second electrode connected to the first node.

17. The display apparatus of claim 11, wherein the first output part comprises:

a seventh transistor comprising a control electrode connected to the first node, a first electrode configured to receive the second clock signal and a second electrode connected to a first output terminal; and a second capacitor comprising a first electrode connected to the first output terminal and a second electrode connected to the first node.

18. The display apparatus of claim 17, wherein the second output part comprises:

a sixth transistor comprising a control electrode connected to the second node, a first electrode configured to receive the driving voltage, and a second electrode connected to the first output terminal; and a first capacitor comprising the first electrode configured to receive the driving voltage and a second electrode connected to the second node.

19. The display apparatus of claim 18, wherein the first output part comprises:

a seventeenth transistor comprising a control electrode connected to the first node, a first electrode configured to receive a third clock signal having a different phase from the first and second clock signals, and a second electrode connected to a second output terminal; and a fourth capacitor comprising a first electrode connected to the second output terminal and a second electrode connected to the first node.

20. The display apparatus of claim 19, wherein the second output part comprises a sixteenth transistor comprising a control electrode connected to the second node, a first electrode configured to receive the driving voltage, and a second electrode connected to the second output terminal.

* * * * *